United States Patent [19]

Wendt

[11] 4,214,414

[45] Jul. 29, 1980

[54] REMOUNTABLE UNITARY WALL BASE TRIM

[75] Inventor: Alan C. Wendt, Barrington, Ill.

[73] Assignee: United States Gypsum Company, Chicago, Ill.

[21] Appl. No.: 943,585

[22] Filed: Sep. 18, 1978

[51] Int. Cl.[2] ..... E04F 19/04

[52] U.S. Cl. ..... 52/288; 52/242; 174/48; 174/97

[58] Field of Search ..... 52/287, 288, 242, 221; 174/48, 97, 101

[56] References Cited

U.S. PATENT DOCUMENTS

| | | | |
|---|---|---|---|
| 2,910,033 | 10/1959 | Weisburg | 52/717 |
| 3,786,171 | 1/1974 | Shira | 174/97 |
| 4,065,900 | 1/1978 | Eggert | 52/781 |

FOREIGN PATENT DOCUMENTS

| | | | |
|---|---|---|---|
| 2124163 | 11/1972 | Fed. Rep. of Germany | 174/101 |
| 1305181 | 8/1962 | France | 174/97 |

*Primary Examiner*—James L. Ridgill

*Attorney, Agent, or Firm*—Glenn W. Ohlson; Samuel Kurlandsky; Robert H. Robinson

[57] ABSTRACT

A remountable unitary extruded plastic base for wall construction providing a decorative finished appearance, said extrusion having a preinstalled generally L-shape comprising a first leg connected to a second longer leg by means of a flexible hinge connection wherein the first leg is rotated to snap engage with the second leg to thereby conceal an attachment surface having fasteners therethrough, wherein the attachment surface and fasteners are concealed within a pocket portion between the first leg and second leg.

11 Claims, 3 Drawing Figures

REMOUNTABLE UNITARY WALL BASE TRIM

THE BACKGROUND OF THE INVENTION (1) Field of the Invention

The present invention relates to an extruded unitary plastic base providing a decorative trim appearance at the base of a wall wherein the extrusion is fully remountable at other wall locations.

(2) Description of the Prior Art

In the past, many materials and means of attachment were provided at the intersection of a wall and floor to present a decorative appearance. Additionally, the base member added protection to wall surfaces which could be damaged through normal pedestrian traffic. The base also served as a finishing member concealing irregularities between the floor surface and installed wall.

Many materials have been provided for base trim and include typical materials such as steel, wood, plastic, aluminum, rubber, and many others. The most common material utilized in wall partition construction having parallel spaced apart wall panels is a vinyl base.

Presently, conventional vinyl base elements are applied with a mastic adhesive. This manner of construction is referred to as a "top-set" trim. Application of this type is very slow and it is sometimes difficult to adhere the base to wall surfaces if they are vinyl covered. Additionally, the vinyl base is not reusable, or remountable, since the mastic hardens and prevents removal of the base trim without extreme damage taking place.

Other manners of attachment have been utilized for vinyl bases. Several of these involve screw fasteners or nails penetrating the base and passing through the wall partition to engage a stud. The inclusion of screw fasteners, or the like, diminishes the desirable aesthetic appearance which the trim should provide. Therefore, in attempting to overcome this problem, some wall systems utilize a base trim in which a flap or sliding cover is provided to hide screw fasteners after engagement. When additional components such as cover slides or splines are utilized to cover the attachment surface, the cost of providing the trim is significantly increased. When unitary base members have been provided, the folding flap presents the consequential problem of fold lines and discoloration along the axis of rotation as the vinyl is both tensed and compressed during folding.

Another problem with folded-over concealment of attachment surfaces involves the undesirable appearance of joint lines which break the continuous decorative effect at such locations.

(3) Objects of the Invention

It is therefore a major object of this invention to provide a remountable unitary base trim for wall construction which is reusable at other wall locations.

It is also an important object of this invention to provide a base for wall construction which provides a concealed attachment surface.

It is also a related object of this invention to provide a unitary extruded plastic base which comprises a hinged snap engageable leg for covering an attachment surface without an unsightly bend line appearing on exposed surfaces to destroy the decorative effect.

It is a concomitant object of this invention to provide a unitary extruded plastic base which compensates for irregularities in the floor surface.

It is a correlated goal of this invention to provide a base trim member for use in a wall partitions system utilizing gypsum wallboard panels.

SUMMARY OF THE INVENTION

In attaining the goals and objects of this invention, a remountable unitary extruded plastic base for wall construction is provided. The base provides a decorative finished appearance and has a preinstalled generally L-shape.

The extruded base of this invention has a first leg which has two opposite edges wherein one edge has an inturned stub member disposed at right angles connecting the leg to a flexible hinge. At the opposite edge of the first leg, a snap engageable lip portion is disposed. The base has a second leg which has an upper and lower edge. The upper edge of the second leg is connected to the flexible hinge means at generally right angles to the first leg. The second leg is longer than the first leg and has a node member located thereon providing snap engageability with the lip portion of the first leg. Said first leg is rotatable about the hinge means allowing the lip portion to engage the node portion as the first leg moves toward the second leg. Said second leg comprises a planar attachment surface located between the hinge and node member adapted to receive screw fasteners therethrough for securement to a wall.

The flexible hinge of the base trim member of this invention comprises a V-shaped notch between the inturned stub of the first leg and the upper edge of the second leg. The first leg is thereby rotatable toward the second leg to snap engage and cover the attachment surface concealing the fasteners within a pocket portion defined between the first leg and attachment surface. Upon snap engagement, the first leg is disposed in parallel planar spaced apart relationship with said attachment surface of the second leg.

A decorative trim appearance is therefore provided having no bend line exposed to view to diminish the aesthetic effect.

BRIEF DESCRIPTION OF THE DRAWINGS

The foregoing and other and more specific objects of the invention are attained by the construction and arrangement illustrated in the accompanying drawings wherein.

DESCRIPTION OF THE PREFERRED EMBODIMENTS

Figure 1:
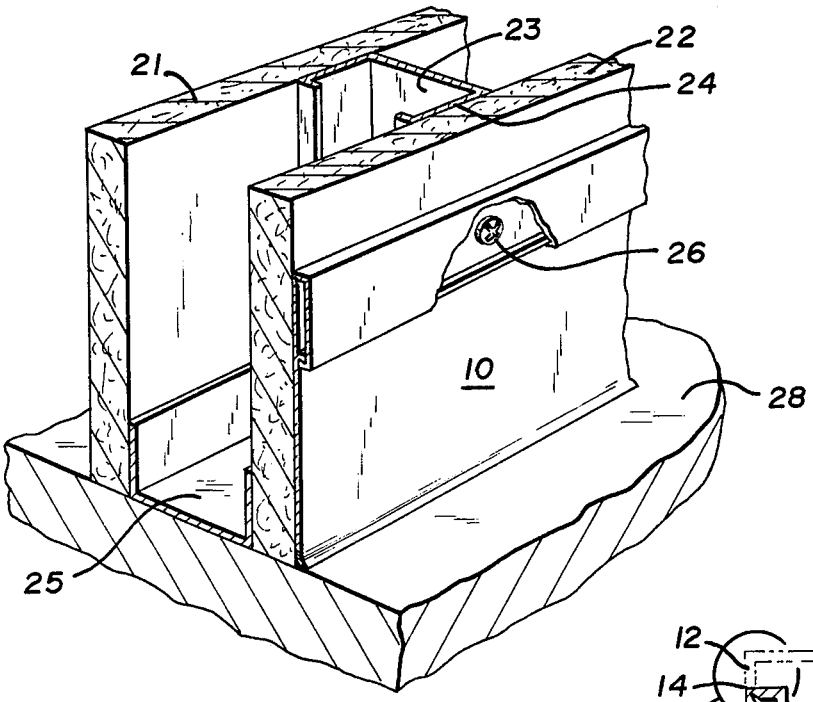
FIG. 1 is a fragmentary partially broken away perspective view of a wall partition structure having the base trim member of this invention attached to the wall in accordance with this invention.

FIG. 1 illustrates the invention in installed form. Base trim 10 is shown in partially broken away perspective view attached in a wall construction. The conventional wall construction envisioned for use with this invention features parallel spaced apart wall panels shown as panel 21 and panel 22. Therebetween, at periodic intervals, a plurality of studs 23 are disposed for support. Along floor surface 28, a floor runner 25 is provided for stud and panel securement. Stud 23 is preferably roll-formed steel having a C-shape. Attachment flange 24, of stud 23, is an arm of the "C" affording a securement surface for base trim member 10.

Fasteners secure base trim 10 to wall panel 22 and are disclosed to desirably be screw fasteners 26 positioned in correspondence with stud locations such as at stud 23.

As illustrated in FIG. 1, base trim 10 of this invention provides a decorative exposed surface wherein the screw fastener 26 is concealed from view.

Figure 3:
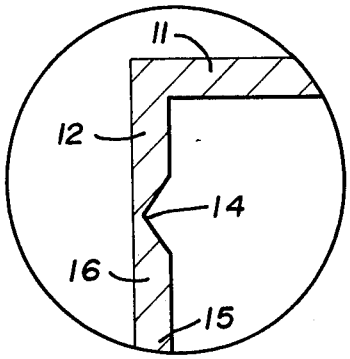
FIG. 3 is a detail view of the flexible hinge of the base trim member shown in FIG. 2.
Figure 2:
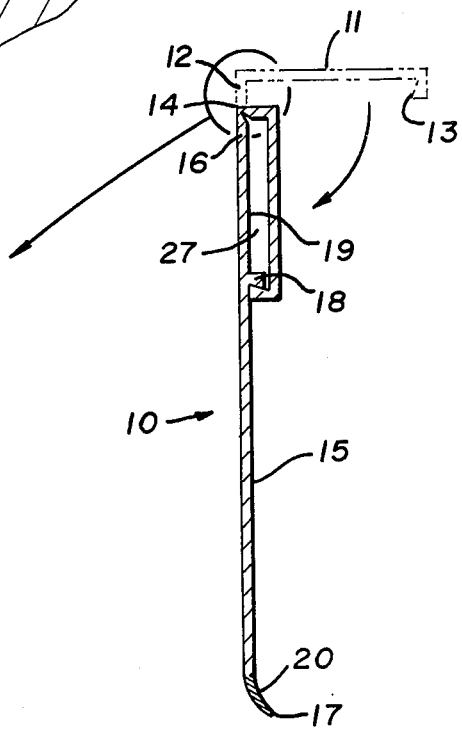
FIG. 2 is a cross-sectional view of the base member of this invention illustrating the preinstalled L-shape and installed snap-on engagement positions.

Turning now to FIGS. 2 and 3, base trim member 10 is shown in cross-sectional view. Base trim member 10 comprises first leg 11 and a second leg 15. First leg 11 has at one of two opposite edges an inturned stub 12 which is disposed generally at right angles thereto. At the opposite edge lip portion 13 extends downwardly substantially the same distance as inturned stub 12. Lip portion 13 has a slightly bevelled interior edge to facilitate snap engageability. First leg 11 connects to second leg 15 by a hinge means disclosed as V-shaped notch 14 as best seen in FIG. 3. V-shaped notch 14 connects the inturned stub 12 of first leg 11 to an upper edge 16 of second leg 15. Second leg 15 contacts floor surface 28 at lower edge 17. Disposed between upper edge 16 and lower edge 17 is node portion 18 which is located on second leg 15 in positional correspondence with lip portion 13 of first leg 11. Upon rotation of first leg 11, as shown by the arrow, lip portion 13 contacts the node portion 18 along corresponding bevelled surfaces to provide a snap engagement and thereby lock first leg 11 in place. Below said node portion 18, the remainder of second leg 15 comprises a lower surface exposed to view following snap engagement.

Between upper edge 16 and node portion 18 a planar attachment surface 19 resides. This surface is adapted to permit screw fasteners, or the like, to pass therethrough for attachment to wall panels as illustrated in FIG. 1 with screw fastener 26 attaching to wall panel 22 and stud 23. Due to the substantially equivalent lengths of inturned stub 12 and lip portion 13, first leg 11 resides in spaced apart parallel planar relationship with attachment surface 19. In this manner a pocket portion 27, preferably having a generally rectangular cross-section, is thereby provided for covering fastener heads or the like.

In the preferred embodiment of this invention lower edge 17 has a curved portion shown as arcuate terminus 20. Arcuate terminus 20 curves outwardly and downwardly from second leg 15 to contact floor surface 28. In the preferred embodiment the base trim 10 is comprised of an extruded rigid vinyl such as polyvinyl chloride. Additionally, the preferred embodiment for base trim 10 provides a dual extrusion wherein arcuate terminus 20 is a more flexible rigid vinyl than the rest of second leg 15. In providing this dual extrusion, arcuate terminus 20 is more flexible for conformance with floor irregularities to provide continuous contact between the trim base trim 10 and floor surface 28. A desirable object is thereby attained in providing a finished trim appearance for wall construction.

Base trim 10 preferably has an extruded thickness of first and second legs 11 and 15 of from about 0.025 inches to about 0.100 inches. Also, the thickness of the V-shaped notch 14 is preferably of from about 0.005 inches to about 0.020 inches at the apex of the "V". With this reduced thickness, the amount of discoloration which normally occurs when rigid vinyl is bent is almost eliminated. Secondly, by providing V-shaped notch 14 at the panel side of second leg 15, any minimal discoloration at the bend line is not exposed to destroy the desirable aesthetic quality.

Installation time is greatly reduced since, with the use of screw fasteners 26 at stud 23 locations, base trim 10 may be readily installed without requiring mastic cement application procedures. Additionally, with the snap engageability of first leg 11 to second leg 15, the base trim 10 may be readily demounted for reinstallation at other wall locations simply by un-snapping first leg 11 and withdrawing screw fasteners 26 from engagement. This permits reusability in a facile manner characterized by relatively simple construction that eliminates replacement part costs. Base trim 10 of this invention is provided for use in the preferred embodiment with gypsum board wall partitions systems, however, its applicability is not limited to gypsum board and may be readily used with other wall constructions having either single or double panel construction.

The embodiment disclosed herein is presently considered to be the preferred form of the invention but changes and modifications may be made therein and it is intended that the claims appended hereto shall cover such changes which fall within the scope of the invention.

I claim:

1. A remountable unitary extruded plastic base for wall construction providing a decorative finished appearance, said extrusion having a pre-installed generally L-shape comprising:

a first leg having two opposite edges wherein one edge has an inturned stub member disposed at right angles thereto and connecting the leg to a flexible hinge means, and the other edge having a snap engageable lip portion;

a second leg having an upper and lower edge, the upper edge being connected to said flexible hinge means, said second leg being longer than said first leg and having a node member located thereon to provide snap engageability with the lip portion upon rotation of said first leg around said hinge means toward said second leg, and a planar attachment surface along said second leg located between the hinge means and node member adapted to receive fasteners therethrough for securement to a wall; and said flexible hinge means comprising a V-shaped notch connecting the inturned stub and upper edge of the second leg, whereby the first leg is rotatable toward the second leg to snap engage the lip portion to said node member, wherein the first leg resides in parallel planar spaced apart relationship with the attachment surface to cover the attachment surface and conceal fasteners within a pocket portion defined therebetween thereby providing a decorative trim appearance.

2. A remountable one-piece extruded plastic base as claimed in claim 1 wherein the thickness of the first and second legs is from about 0.025 inches to about 0.100 inches.

3. A remountable one-piece extruded plastic base as claimed in claim 2 wherein the thickness of the hinge at the apex of the V-shaped notch is from about 0.005 inches to about 0.020 inches.

4. A remountable one-piece extruded plastic base as claimed in claim 1 wherein the bottom edge of the second leg has an arcuate terminus curving outwardly and downwardly to provide a meeting edge for contact along floor surfaces.

5. A remountable one-piece extruded plastic base as claimed in claim 4 wherein the base is extruded from rigid vinyl.

6. A remountable one-piece extruded plastic base as claimed in claim 5 wherein the base is a dual extrusion having a relatively more flexible vinyl comprising the arcuate terminus portion to provide sufficient flexibility to conform to irregularities in floor surfaces.

7. In combination, a wall and floor construction and base trim member demountably secured to said wall at the floor line, the base trim having two legs being snap engageable and disengageable comprising:

a first leg having at one edge a snap-on engageable lip portion and at an opposite edge a flexible hinge;

a second leg connected to said first leg at said flexible hinge and being longer than the first leg wherein said second leg has a snap-on engageable node portion engageable with said lip portion, and having a planar attachment surface defined between the hinge and node providing a surface for fasteners to pass therethrough to secure the base trim to said wall, said second leg having a lower exposed surface disposed below said node portion;

said flexible hinge enabling the first leg to rotate toward said second leg to snap-on engage the lip and node portions, wherein said first leg is spaced-apart in a parallel planar relationship with said second leg to define a pocket portion therebetween concealing said attachment surface and fasteners therein.

8. The combination as claimed in claim 7 wherein the base trim comprises a rigid vinyl extrusion with said first and second legs having a thickness of from about 0.025 inches to about 0.100 inches.

9. The combination as claimed in claim 8 wherein said hinge means comprises a V-shaped notch having a thickness at the apex of from about 0.005 inches to about 0.020 inches.

10. The combination as claimed in claim 8 wherein the second leg has an arcuate terminus at the floor curving outwardly and downwardly, and contacting said floor.

11. The combination as claimed in claim 10 wherein the base trim member is extruded from vinyls of two different rigidities wherein the arcuate terminus is relatively more flexible than the remainder of the base trim to thereby facilitate conformance to irregularities in the floor surface.

* * * * *